US008172629B2

(12) United States Patent
Ozaki

(10) Patent No.: US 8,172,629 B2
(45) Date of Patent: May 8, 2012

(54) PERSONAL WATERCRAFT

(75) Inventor: Atsufumi Ozaki, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 276 days.

(21) Appl. No.: 12/649,511

(22) Filed: Dec. 30, 2009

(65) Prior Publication Data

US 2011/0159753 A1 Jun. 30, 2011

(51) Int. Cl.
*B63H 20/00* (2006.01)

(52) U.S. Cl. ..... 440/88 L; 440/88 HE

(58) Field of Classification Search ..... 440/88 L, 440/88 C, 88 HE
See application file for complete search history.

(56) References Cited

U.S. PATENT DOCUMENTS

| | | | | |
|---|---|---|---|---|
| 6,244,385 | B1 * | 6/2001 | Tsubata et al. | 184/6.4 |
| 7,980,906 | B2 * | 7/2011 | Ozaki et al. | 440/88 HE |
| 2007/0272194 | A1 * | 11/2007 | Hoi et al. | 123/196 R |
| 2008/0093066 | A1 * | 4/2008 | Bird et al. | 165/297 |

FOREIGN PATENT DOCUMENTS

| | | |
|---|---|---|
| JP | 2004-162669 | 6/2004 |
| JP | 2004-257351 | 9/2004 |
| JP | 2004-360671 | 12/2004 |

* cited by examiner

*Primary Examiner* — Stephen Avila

(74) *Attorney, Agent, or Firm* — Alleman Hall McCoy Russell & Tuttle LLP

(57) ABSTRACT

A personal watercraft comprises an oil cooler including an oil cooling passage through which oil circulating inside an engine flows and a coolant passage through which coolant for cooling the oil in the oil cooling passage flows; a first oil passage through which the oil flowing toward the oil cooling passage flows; a second oil passage through which the oil flowing out from the oil cooling passage flows; a bypass passage connecting the first oil passage to the second oil passage so as to bypass the oil cooling passage; and a valve configured to open and close the bypass passage; wherein the valve opens the bypass passage when the temperature of the oil is lower than a predetermined value and closes the bypass passage when the temperature of the oil is not lower than the predetermined value.

9 Claims, 12 Drawing Sheets

PERSONAL WATERCRAFT

TECHNICAL FIELD

The present invention relates to a personal watercraft including an oil cooler configured to cool oil circulating in the interior of an engine.

BACKGROUND ART

In the interior of an engine built into personal watercraft, oil circulates to lubricate, cool and seal engine components. Lubricating, cooling, and sealing capabilities are varied depending on the temperature of the oil. To achieve sufficient capabilities, it is necessary to properly control the temperature of the oil.

If the engine continues running under a high load, then the temperature of the oil circulating inside thereof rises undesirably excessively. To avoid this, personal watercraft disclosed in Japanese Laid-Open Patent Application Publication No. 2004-360671 includes an oil cooler for cooling oil. A coolant for use in heat exchange is fed to the oil cooler. As the coolant, water outside the watercraft such as sea water and lake water is used. The coolant is also used to cool the engine.

The temperature of the water outside the watercraft is varied depending on season and location. It is difficult to control the temperature of the oil using the coolant which is variable in temperature. Especially, in winter season, the temperature of the water outside the watercraft is often close to zero degrees centigrade. The oil flowing through the oil cooler is cooled excessively by heat exchange with the coolant. In addition, a substantial time lapses until the engine cooled by the coolant is warmed up. Therefore, the temperature of oil circulating inside the engine is not easily increased but a very long time lapses until the temperature of the oil rises to a suitable one and the oil exhibits desired capability.

SUMMARY OF THE INVENTION

A personal watercraft of the present invention comprises an oil cooler including an oil cooling passage through which oil circulating inside an engine flows and a coolant passage through which coolant for cooling the oil in the oil cooling passage flows; a first oil passage through which the oil flowing toward the oil cooling passage flows; a second oil passage through which the oil flowing out from the oil cooling passage flows; a bypass passage connecting the first oil passage to the second oil passage so as to bypass the oil cooling passage; and a valve configured to open and close the bypass passage; wherein the valve opens the bypass passage when the temperature of the oil is lower than a predetermined value and closes the bypass passage when the temperature of the oil is not lower than the predetermined value.

In accordance with the configuration, when the temperature of the oil is lower than a predetermined value, the oil is allowed to flow in the bypass passage for causing the oil to bypass the oil cooling passage in the oil cooler. On the other hand, when the temperature of the oil is not lower than the predetermined value, the bypass passage is closed and the oil flows in the oil cooling passage. This makes it possible to prevent excess reduction and increase in the oil temperature regardless of the temperature of the coolant. By setting the predetermined value properly, the temperature of the oil can be controlled at a suitable value. As a result, the lubrication, cooling, and sealing can be performed effectively.

The above and further objects and features of the invention will more fully be apparent from the following detailed description with accompanying drawings.

DETAILED DESCRIPTION OF THE PREFERRED EMBODIMENTS

Hereinafter, an embodiment of the present invention will be described with reference to the drawings. The directions are referenced from the perspective of a rider (not shown) riding on the personal watercraft except for cases especially explained.

Figure 1:
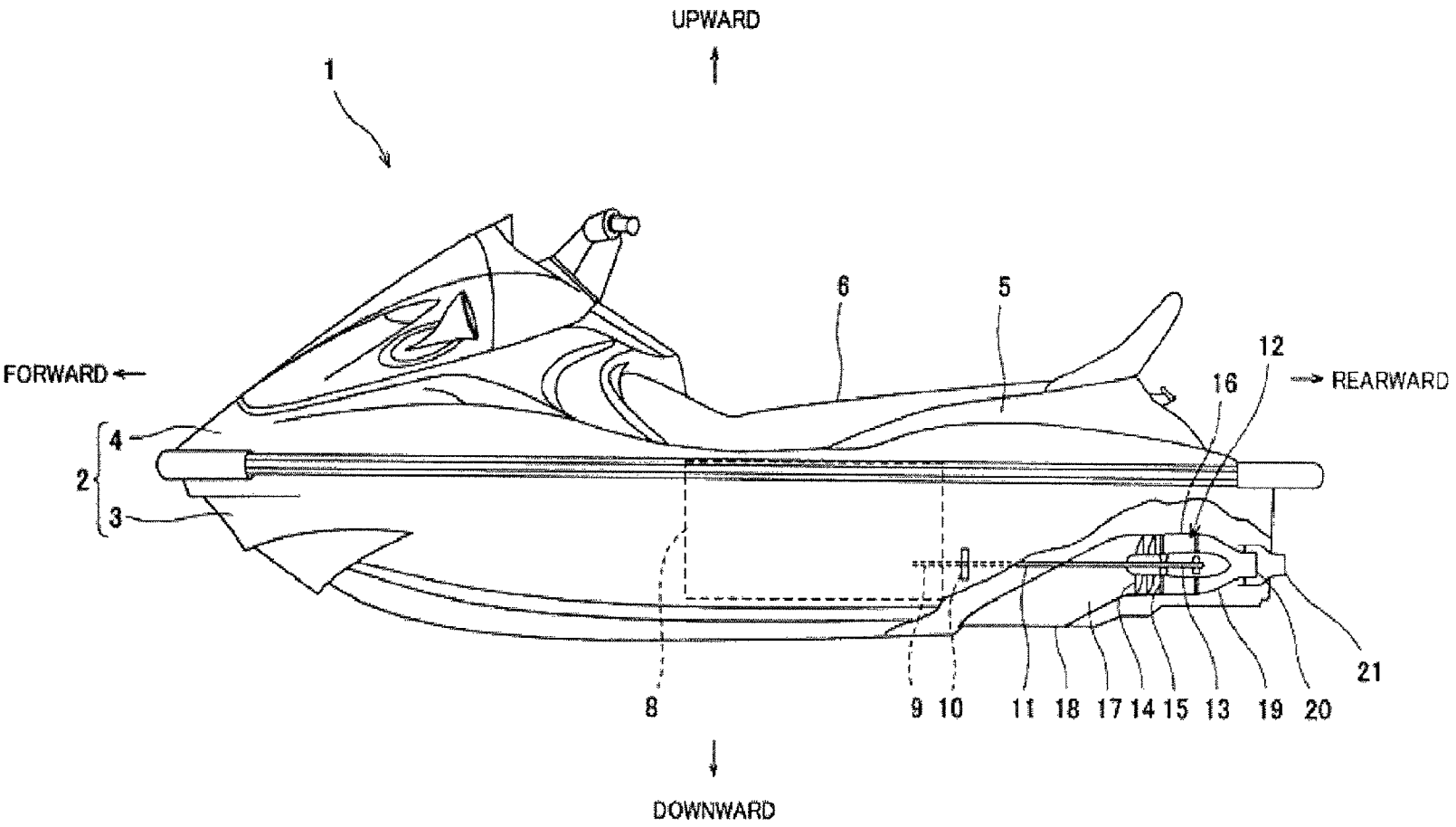
FIG. 1 is a partial cross-sectional view of personal watercraft according to an Embodiment of the present invention, as viewed from the left side.

FIG. 1 is a partial cross-sectional view of personal watercraft according to an Embodiment of the present invention, as viewed from the left side. As shown in FIG. 1, personal watercraft 1 includes a body 2. The body 2 includes a hull 3 and a deck 4 covering the hull 3 from above. The deck 4 has at the rear portion thereof a protruding portion 5 protruding upward from a center region in a width direction thereof. A seat 6 is mounted over the upper surface of the protruding portion 5. An engine 8 is mounted inside an engine room defined by the hull 3 and the deck 4 below the seat 6. The seat 6 is mounted to the body 2 such that the seat 6 is pivotable around a pivot (not shown) at the rear portion thereof or is detachably mounted to the body 2. By pivoting or detaching the seat 6, the engine room is opened. Thereby, the rider can access the engine 8 inside the engine room from above.

A crankshaft 9 of the engine 8 extends in the longitudinal direction of the body 2. The output end portion of the crankshaft 9 is coupled to a propeller shaft 11 via a coupling member 10. The propeller shaft 11 is coupled to a pump shaft 13 of a water jet pump 12 disposed at the rear portion of the body 2. An impeller 14 is attached on the pump shaft 13. A fairing vane 15 is disposed behind the impeller 14. A tubular pump casing 16 is provided at the outer periphery of the impeller 14 so as to cover the impeller 14. The pump casing 16 fluidically communicates with a water intake 18 provided at the bottom of the body 2 through a water passage 17 and is connected to a pump nozzle 19 provided at the rear portion of the body 2. The pump nozzle 19 has a diameter decreasing in a rearward direction. An outlet port 20 is provided at the rear end of the pump nozzle 19. A steering nozzle 21 is coupled to the rear side of the outlet port 20 such that the steering nozzle 21 is pivotable to the right or to the left.

When the engine 8 starts running, the rotation of the crankshaft 9 is transmitted to the pump shaft 13, causing the water jet pump 12 to operate. The water jet pump 12 causes the impeller 14 to rotate according to the driving power of the engine 8, pressuring and accelerating the water sucked through the water intake 18. The water flow is guided by the faring vanes 15, and ejected rearward through the outlet port 20 and the steering nozzle 21. As the resulting reaction of the ejected water flow, the watercraft 1 propels.

Figure 2:
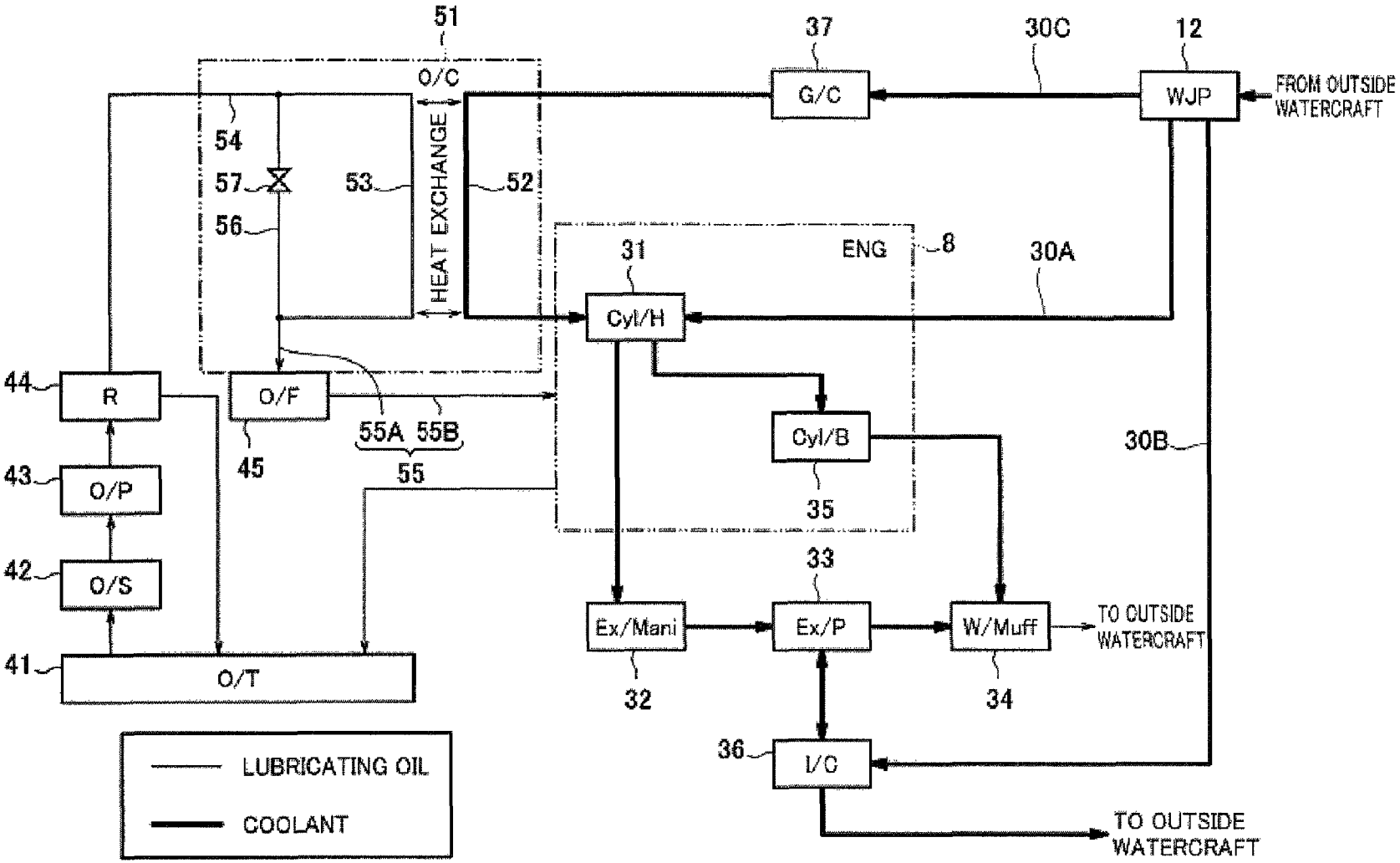
FIG. 2 is a schematic view showing a configuration of a cooling system and a lubricating system of personal watercraft of FIG. 1.

FIG. 2 is a schematic view showing a configuration of a cooling system and a lubricating system of personal watercraft of FIG. 1. In FIG. 2, bold lines indicate the coolant in the cooling system of FIG. 2, and thin lines indicate the flow of the oil in the lubricating system. As shown in FIG. 2, the cooling system of the personal watercraft uses a so-called open-loop water cooling system, in which the water outside the watercraft is taken in for use as the coolant, is circulated inside the engine 8, an exhaust system of the engine 8, and other components, and eventually is discharged outside the watercraft. The water used as the coolant is taken in from outside the watercraft through the water intake 18 (see FIG. 1) by the water jet pump 12. The coolant is fed with a pressure from the water jet pump 12 to separate passages 30A, 30B, and 30C.

A part of the coolant from the water jet pump 12 is directly fed to a cylinder head 31 of the engine 8 through the passage 30A. A part of the coolant inside the cylinder head 31 is fed to an exhaust manifold 32. An exhaust pipe 33 and a water muffler 34 are coupled to the exhaust manifold 32 in this order. The coolant inside the exhaust manifold 32 is discharged outside the watercraft through the exhaust pipe 33 and then the water muffler 34. A part of the coolant inside the cylinder head 31 is fed to a cylinder block 35 coupled to the cylinder head 31. The coolant inside the cylinder block 35 is discharged outside the watercraft through the water muffler 34. In the manner described above, the exhaust system of the engine 8 is cooled.

The engine 8 is equipped with a supercharger (not shown). The watercraft 1 includes an intercooler 36 for cooling the supercharger. A part of the coolant from the water jet pump 12 is directly fed to the intercooler 36 through the passage 30B. The coolant inside the intercooler 36 is discharged outside the watercraft. The coolant passage in the interior of the intercooler 36 communicates with the coolant passage in the interior of the exhaust pipe 33. The coolant flowing through one of the two passages is fed to the other.

The watercraft 1 includes an AC generator (not shown) driven by the crankshaft 9. A generator cover 37 is attached on the engine 8 so as to cover the AC generator. A part of the coolant from the water jet pump 12 is directly fed to the generator cover 37 through the passage 30C. The coolant which has flowed through the generator cover 37 is fed to the oil cooler 51.

The oil cooler 51 includes a coolant passage 52 through which the coolant flows, and an oil cooling passage 53 through the oil which has circulated through the inside the engine 8 flows. When the coolant is flowing through the coolant passage 52, it exchanges heat with the oil flowing through the oil cooling passage 53. Thereby, the oil inside the oil cooling passage 53 is cooled. The coolant which has flowed through the coolant passage 52 of the oil cooler 51 is fed to the cylinder head 31 of the engine 8.

The lubricating system of the watercraft 1 will be described. An oil tank 41 is attached to the lower portion of the engine 8 to store oil. The oil inside the oil tank 41 is suctioned into an oil pump 43 through an oil screen 42 and is fed with a pressure by the oil pump 43. The pressure of the oil which is fed with a pressure by the oil pump 43 is regulated by a regulator 44. The oil with the regulated pressure flows though a first oil passage 54 toward the oil cooling passage 53. The oil flows through the oil cooling passage 53 and then is fed to an oil filter 45 through an upstream portion 55A of a second oil passage 55. The oil filter 45 filters the oil. The oil cleaned by the oil filter 45 is fed to the engine 8 through a downstream portion 55B of the second oil passage 55. As should be appreciated, the second oil passage 55 serves to feed the oil which has flowed through the oil cooling passage 53 to the engine 8. The second oil passage 55 is divided into the upstream portion 55A and the downstream portion 55B at the oil filter 45 provided between the oil cooler 51 and the engine 8.

After the oil is fed to the inside the engine 8, it returns to the oil tank 41. In the interior of the engine 8, the oil lubricates, cools, and seals desired regions, for example, a clearance between the outer peripheral surface of a piston and the inner peripheral surface of the cylinder, and a clearance between the journal of the crankshaft 9 and the inner peripheral surface of the bearing.

The lubricating system further includes a bypass passage 56 connecting the first oil passage 54 to the upstream portion 55A of the second oil passage 55 so as to bypass the oil cooling passage 53, and a valve 57 for opening and closing the bypass passage 56. In a state where the valve 57 opens the bypass passage 56, a substantial part of the oil flowing through the first oil passage 54 flows to the bypass passage 56, that is, a substantial part of the oil bypasses the oil cooling passage 53 of the oil cooler 51 so as to reach the upstream portion 55A of the second oil passage 55, and then is fed to the oil filter 45.

The bypass passage 56 is physically more distant from the coolant passage 52 than the oil cooling passage 53. Therefore, the oil flowing through the bypass passage 56 does not substantially exchange heat with the coolant flowing through the coolant passage 52. In other words, the temperature of the oil flowing through the bypass passage 56 does not substantially change even when there is a difference between the temperature of the oil and the temperature of the coolant flowing through the coolant passage 52. The oil cooling passage 53 has a larger passage resistance than the bypass passage 56. The oil cooling passage 53 has a longer passage length and/or smaller passage cross-sectional area than the bypass passage 56. The oil cooling passage 53 has a sinuous shape which makes the passage resistance larger than that of the bypass passage 56. Therefore, in the state where the valve 57 opens the bypass passage 56 as described above, a large amount of oil flows to the bypass passage 56. The specific example of the structure for achieving this will be described later.

The valve 57 operates according to the temperature of the oil. When the temperature of the oil is lower than a predetermined value, the valve 57 opens the bypass passage 56. On the other hand, when the temperature of the oil is not lower than the predetermined value, the valve 57 closes the bypass passage 56. The predetermined value is a suitable temperature (e.g., 120 degrees centigrade) at which the oil is capable of performing lubrication or cooling most effectively. The suitable temperature may be a temperature higher than a boiling point of the water outside the watercraft used as the coolant.

When the engine 8 continues running under a high load, the temperature of the wall surface of the engine 8 rises and the temperature of the oil circulating inside the engine 8 also rises. When the temperature of the oil reaches the predetermined value or higher, the valve 57 closes the bypass passage 56 and the oil flows through only the oil cooling passage 53. Therefore, the oil with a high-temperature is cooled by heat exchange with the coolant while flowing through the oil cooling passage 53.

When the watercraft 1 starts in winter season, the temperature of the engine 8 is not easily increased and the temperature of the oil is lower than the predetermined value. In this case, the temperature of the water outside the watercraft 1, for use as the coolant, is sometimes near zero degrees centigrade and lower than the predetermined value. Accordingly, the valve 57 opens the bypass passage 56. Since the oil cooling passage 53 has a larger passage resistance than the bypass passage 56, the flow rate of the oil flowing from the first oil passage 54 into the oil cooling passage 53 is smaller than the flow rate of the oil flowing from the first oil passage 54 into the bypass passage 56. Therefore, in the state where the valve 57 opens the bypass passage 56, the oil preferentially flows through the bypass passage 56. This makes it possible to prevent excess cooling. As a result, the temperature of the oil rises relatively quickly.

During running of the engine 8, when the valve 57 continues the above operation, the temperature of the oil does not decrease or increase excessively and is stabilized near the predetermined value, regardless of the temperature of the coolant. By setting the predetermined value to the suitable value as described above, the temperature of the oil can be controlled at a suitable one and the oil is capable of performing lubrication, cooling and sealing effectively.

In the lubricating system, valves are not provided in both of the oil cooling passage 53 and the bypass passage 56 which are branch passages, and the oil cooling passage 53 is always open. The bypass passage 56 to be opened and closed by the valve 57 has a smaller passage resistance than the oil cooling passage 53 which is always open. In the state where the valve 57 is in an open position, a large amount of oil flows through the bypass passage 56. This makes it possible to properly control the flow rate of the oil flowing through the oil cooling passage 53 according to the temperature of the oil with a relatively simple structure including a single valve.

Figure 3:
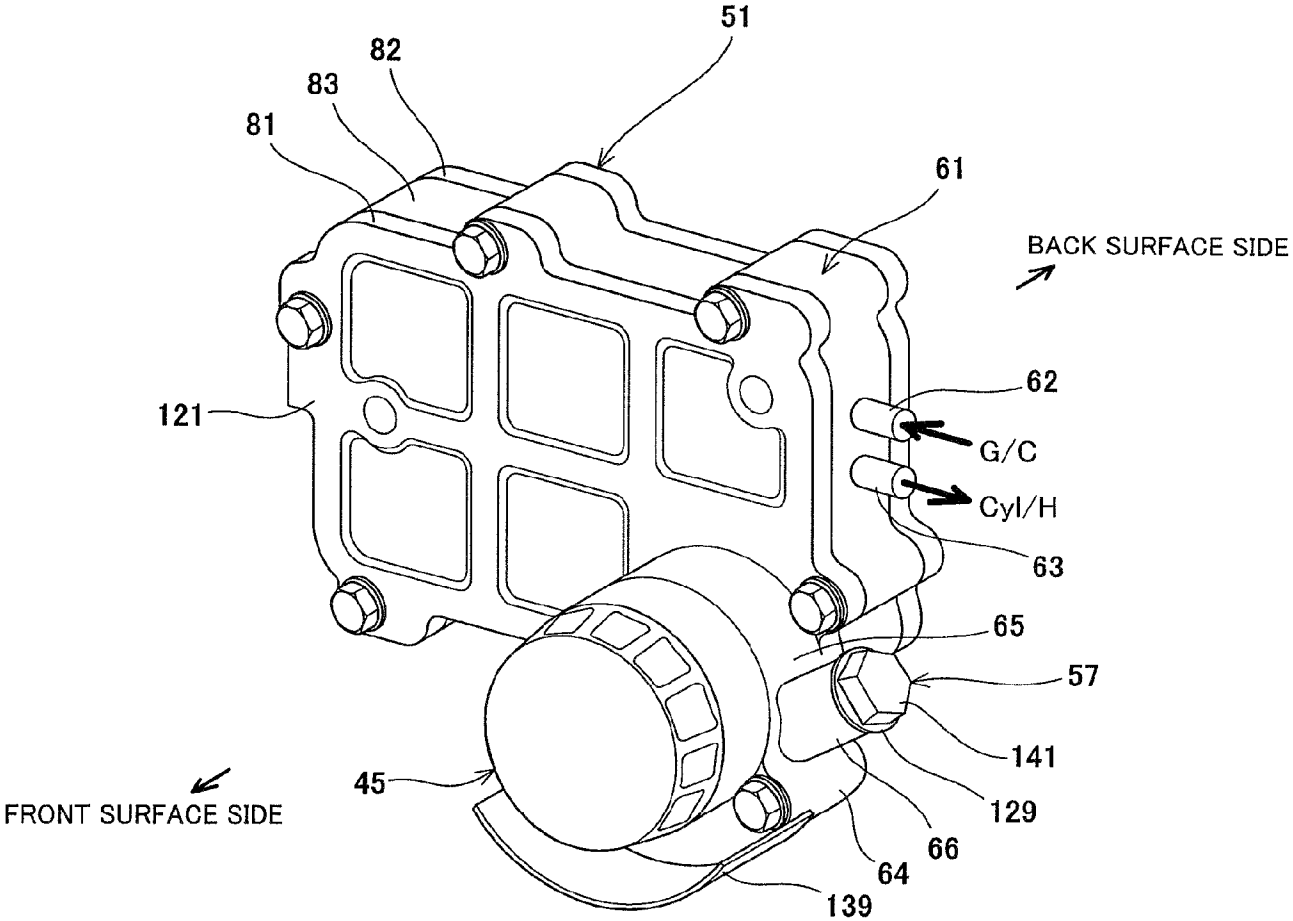
FIG. 3 is a perspective view showing an oil cooler, an oil filter and a valve of FIG. 2.

Hereinafter, a specific example of the structure of the oil cooler 51, the bypass passage 56, and the valve 57 will be described. FIG. 3 is a perspective view of the oil cooler 51. As shown in FIG. 3, the oil cooler 51 has a cooling unit 61 of a substantially rectangular parallelepiped shape. The cooling unit 61 has a structure in which the front surface of a passage plate 83 is covered by a front surface cover 81 and the back surface of the passage plate 83 is covered by a back surface cover 82. A first pipe-shaped tubular joint 62 and a second pipe-shaped joint 63 are attached on the front surface of the cooling unit 61 and are connected with hoses 50 (see FIG. 4A) through which the coolant flows. Inside the cooling unit 61, the coolant passage 52 (see FIGS. 2 and 4B) and the oil cooling passage 53 (see FIGS. 2 and 4B) are provided. The inner space of the first joint 62 communicates with the upstream end portion of the coolant passage 52, while the inner space of the second joint 63 communicates with the downstream end portion of the coolant passage 52.

A valve mounting unit 64 is attached on the front surface of the front surface cover 81. The valve mounting unit 64 includes a cylindrical protruding member 65 protruding from the front surface of a base portion 121 of the front surface cover 81 in a direction perpendicular to the front surface of the base portion 121, and a cylindrical valve accommodating member 66 protruding outward from the outer peripheral surface of the protruding member 65. The cylindrical oil filter 45 is removably mounted to the end surface of the protruding member 65. The valve 57 is removably mounted to the valve accommodating member 66. Thus, the protruding member 65 of the valve mounting unit 64 serves as a filter mounting member used for mounting the oil filter 45. In particular, the front surface of the protruding member 65 serves as a seat on which the oil filter 45 is mounted. Since the oil cooler 51 is integrally mounted to the oil filter 45 and the valve 57 to form an assembly, the components of the lubricating system are made compact.

The protruding member 65 of the valve mounting unit 64 is positioned inward relative to the front surface cover 81 as viewed from the normal line direction of the front surface of the base portion 121. The oil filter 45 mounted to the protruding member 65 of the valve mounting unit 64 is also positioned inward relative to the cooling unit 61 as viewed from the normal line direction of the front surface of the base portion 121. This makes it possible to reduce the size of the assembly of the oil cooler 51, the oil filter 45 and the valve 57 which are integrally mounted, as viewed from the above. An oil receiver 139 protrudes from the lower portion of the valve mounting unit 64. The oil receiver 139 serves to prevent dropping of the oil inside the engine room when the oil filter 45 is detached.

Figure 4A:
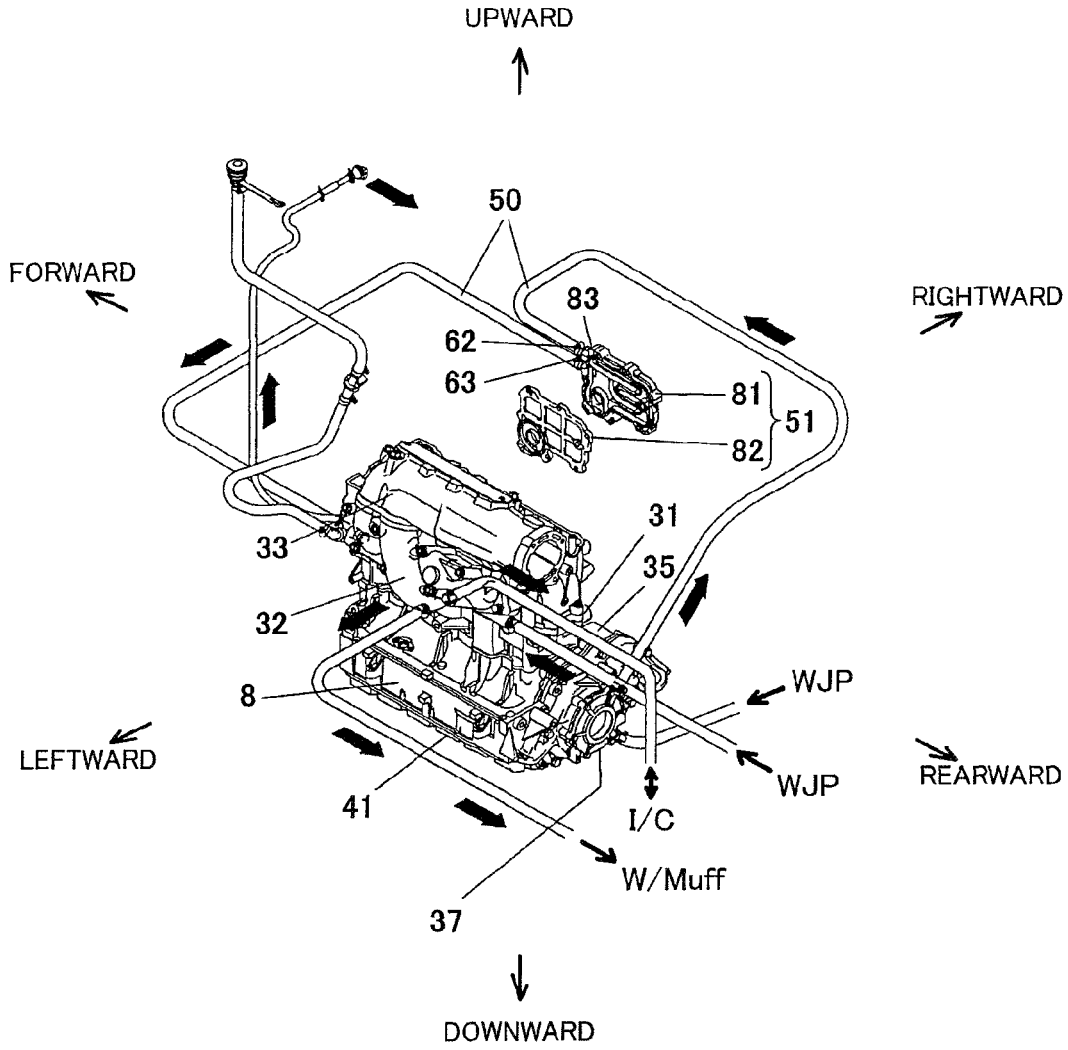
FIG. 4A is a perspective view showing arrangement of the oil cooler and the engine of FIG. 3
Figure 4B:
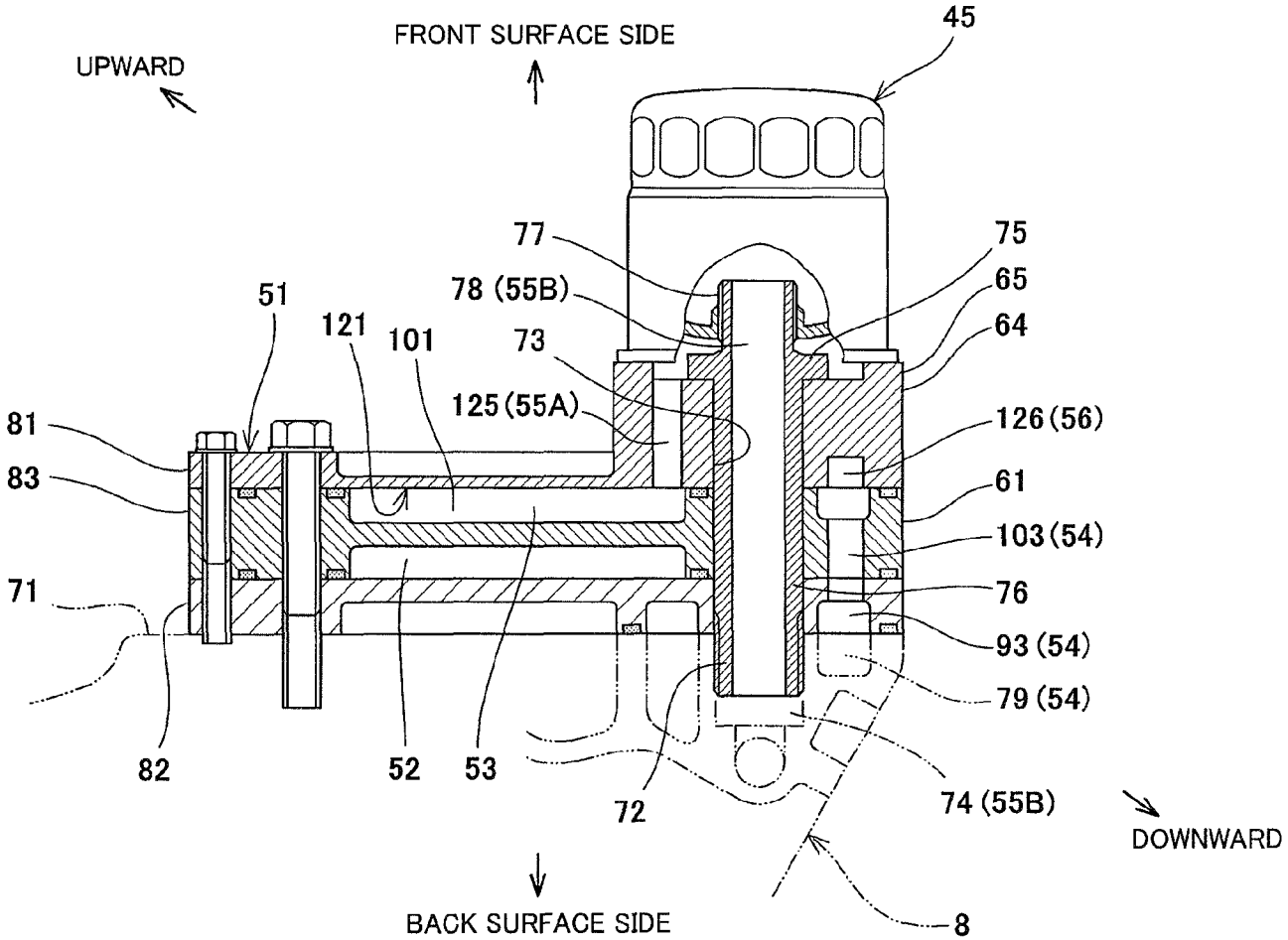
FIG. 4B is a partial cross-sectional view showing the oil cooler of FIG. 3.

FIG. 4A is a perspective view showing the arrangement of the engine 8 and the oil cooler 51 and FIG. 4B is a partial cross-sectional view showing the oil cooler 51 mounted to the engine 8. As shown in FIG. 4A, the oil cooler 51 is mounted to the right upper portion of the engine 8. In this case, the oil cooler 51 is mounted to the engine 8 in such a manner that the valve mounting unit 64 (see FIG. 3) at the front surface side is oriented outward to the right and positioned at the front lower portion of the cooling unit 61. In this state, the valve accommodating member 66 (see FIG. 3) is disposed so as to extend forward and upward from the protruding member 65.

As shown in FIG. 4B, a cooler mounting seat 71 is provided on the outer wall surface of the engine 8 to mount the oil cooler 51 to the engine 8. The cooler mounting seat 71 has a flat surface. The oil cooler 51 is threadedly engaged with the engine 8 in a state where the back surface of the back surface cover 82 is joined to the flat surface of the cooler mounting seat 71. Since the assembly of the oil cooler 51, the oil filter 45 and the valve 57 (see FIG. 3) has a small size as viewed from above, a space required for the cooler mounting seat 71 is advantageously small.

The normal line of the surface of the cooler mounting seat 71 is oriented obliquely upward. Because of this, when the rider opens the engine room, the rider can clearly see the oil cooler 51 accommodated along with the engine 8 within the engine room, and can easily access the oil cooler 51. Therefore, the rider can easily perform maintenance of the oil cooler 51.

The oil cooler 51 and the cooler mounting seat 71 have through-holes 73 and 74, respectively, through which a pipe member 72 is inserted. The through-hole 73 of the oil cooler 51 penetrates the center portion of the protruding member 65 in a thickness direction thereof. The pipe member 72 has a flange portion 75 at an axial intermediate portion thereof and includes a long first pipe portion 76 and a short second pipe portion 77 which are separated in the axial direction at the flange portion 75. A male thread is formed on the outer peripheral surface of the first pipe portion 76. By inserting the first pipe member 76 into the through-holes 73 and 74 and tightening it and by using other bolts, the oil cooler 51 is threadedly engaged with the engine 8. In this case, the flange portion 75 is caused to contact the end surface of the protruding member 65 and the second pipe portion 77 of the pipe member 72 protrudes from the end surface of the protruding member 65. A male thread is formed on the outer peripheral surface of the second pipe portion 77. The oil filter 45 is threadedly engaged with the oil cooler 51 by the second pipe portion 77.

An engine oil passage through which the oil flows is formed on the wall of the engine 8. This eliminates a need for a separate pipe used to flow the oil within the engine 8. The pipe member 72 has an axial hole 78 axially penetrating it. The axial hole 78 serves as a passage through which the oil filtered by the oil filter 45 is fed to the engine 8, i.e., a part of the downstream portion 55B of the second oil passage 55. The through-hole 74 of the cooler mounting seat 71 into which the pipe member 72 is inserted communicates with the axial hole 78 and serves as the engine oil passage forming a part of the downstream portion 55B of the second oil passage 55. In addition, an engine oil passage 79 opens on the cooler mounting seat 71 at a location in close proximity to the through-hole 74 and forms a part of the first oil passage 54. The oil having a pressure regulated by the regulator 44 and flowing through the engine oil passage 79 flows into the cooling unit 61 of the oil cooler 51 from the back surface side of the oil cooler 51.

Figure 5C:
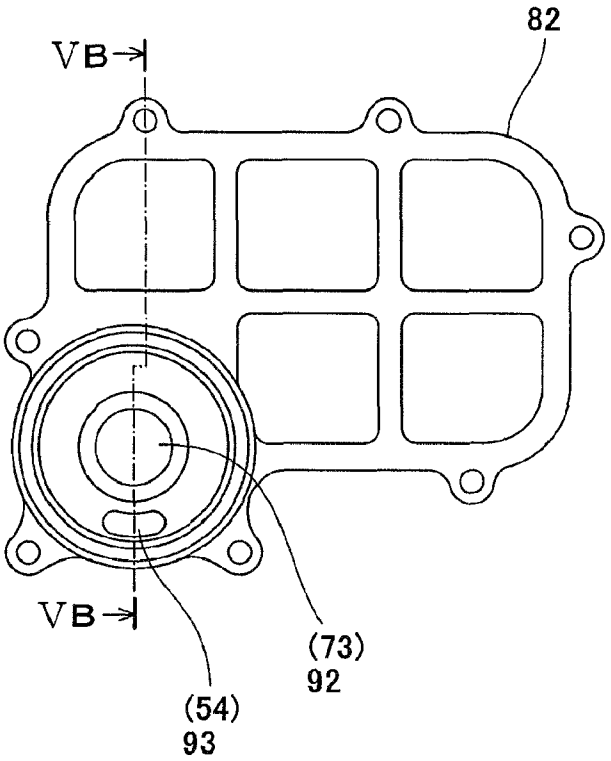
FIG. 5C is a rear view of the back surface cover.
Figure 5B:
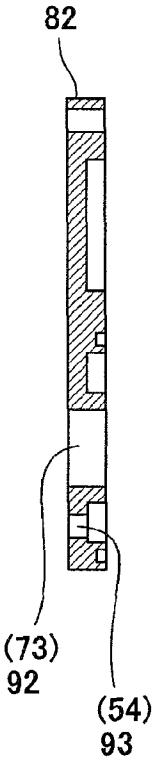
FIG. 5B is a cross-sectional view of the back surface cover taken along line VB-VB of FIGS. 5A and 5C.
Figure 5A:
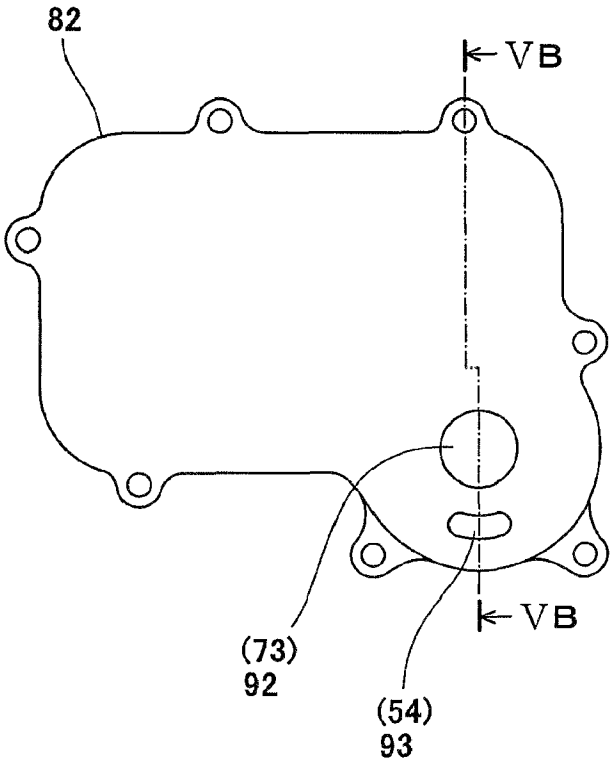
FIG. 5A is a front view of a back surface cover forming the oil cooler of FIGS. 4A and 4B.

FIGS. 5A to 5C show the back surface cover 82. As shown in FIGS. 5A to 5C, the front surface of the back surface cover 82 is substantially flat. The back surface cover 82 has a hole 92 with a large diameter penetrating in a thick direction thereof. The hole 92 forms the through-hole 73 into which the pipe member 72 (see FIG. 4B) is inserted. In the vicinity of the hole 92, an oil inflowing hole 93 penetrates the back surface cover 82 in the thickness direction. The oil inflowing hole 93 communicates with the engine oil passage 79 (see FIG. 4B).

Figures 6A, 6B, 6C:
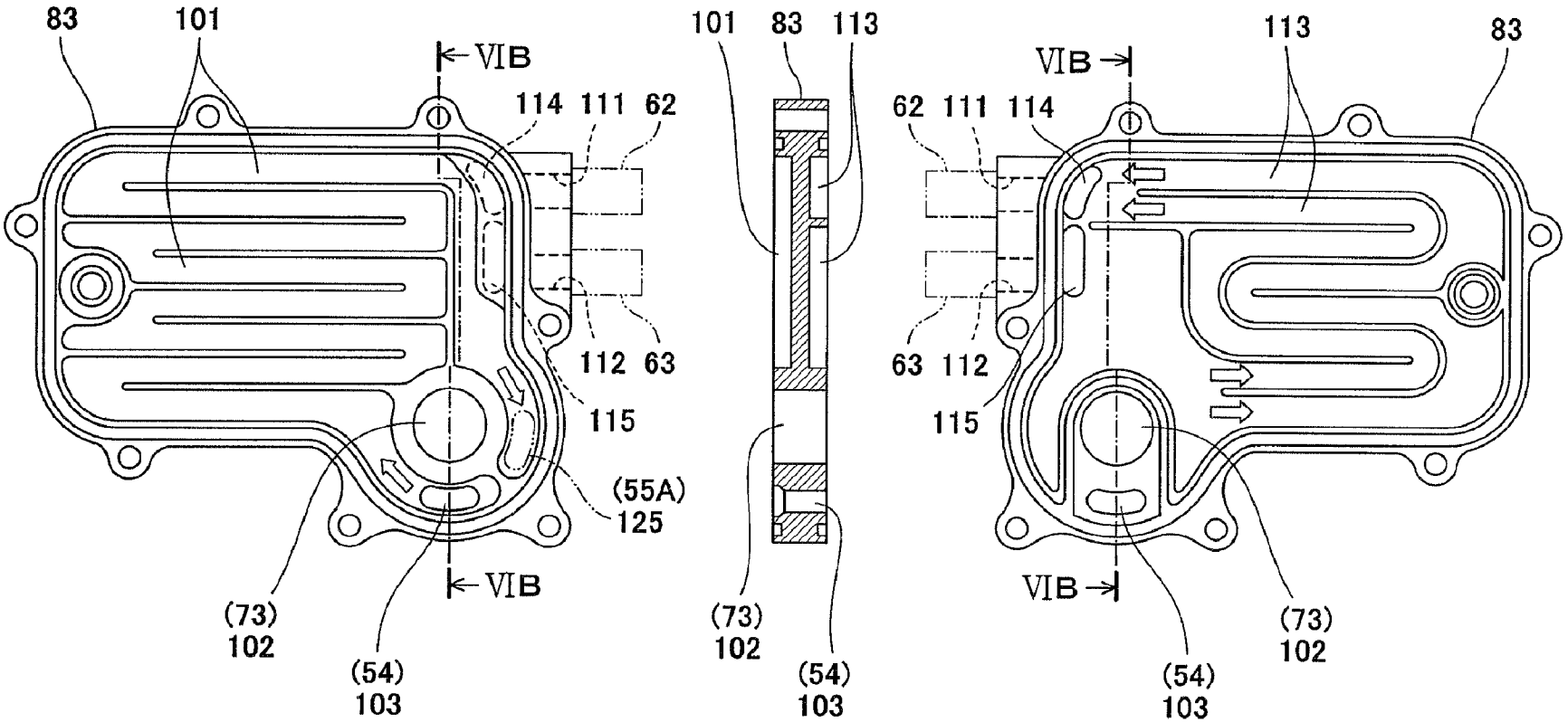
FIG. 6A is a front view of a passage plate forming the oil cooler of FIGS. 4A and 4B.
FIG. 6B is a cross-sectional view of the passage plate taken along line of VIB-VIB of FIGS. 6A and 6C.
FIG. 6C is a rear view of the passage plate.

FIGS. 6A to 6C show the passage plate 83. As shown in FIGS. 6A to 6C, an oil channel 101 is formed on the front surface of the passage plate 83 so as to extend sinuously. The passage plate 83 has a hole 102 with a large diameter penetrating in the thickness direction thereof. The hole 102 forms the through-hole 73 into which the pipe member 72 (see FIG. 4B) is inserted. In the vicinity of the hole 102, an oil inflowing hole 103 penetrates the passage plate 83 in the thickness direction. The oil inflowing hole 103 opens in the start end portion of the oil channel 101.

Inside the passage plate 83, a coolant inflowing hole 111 and a coolant outflowing hole 112 are formed. The coolant inflowing hole 111 and the coolant outflowing hole 112 open in the side surface of the passage plate 83. The coolant inflowing hole 111 has a female thread on the inner peripheral surface thereof, and the coolant outflowing hole 112 has a female thread on the inner peripheral surface thereof. The first joint 62 and the second joint 63 are threaded into the holes 111 and 112, respectively.

The passage plate 83 has a coolant channel 113 extending sinuously on the back surface thereof. The coolant inflowing hole 111 communicates with the start end portion of the coolant channel 113 via a communicating port 114. The coolant outflowing hole 112 communicates with the terminal end portion of the coolant channel 113 via a communicating port 115. The coolant channel 113 is positioned so as not to interfere with the hole 102 and the oil inflowing hole 103.

Figures 7A, 7B, 7C:
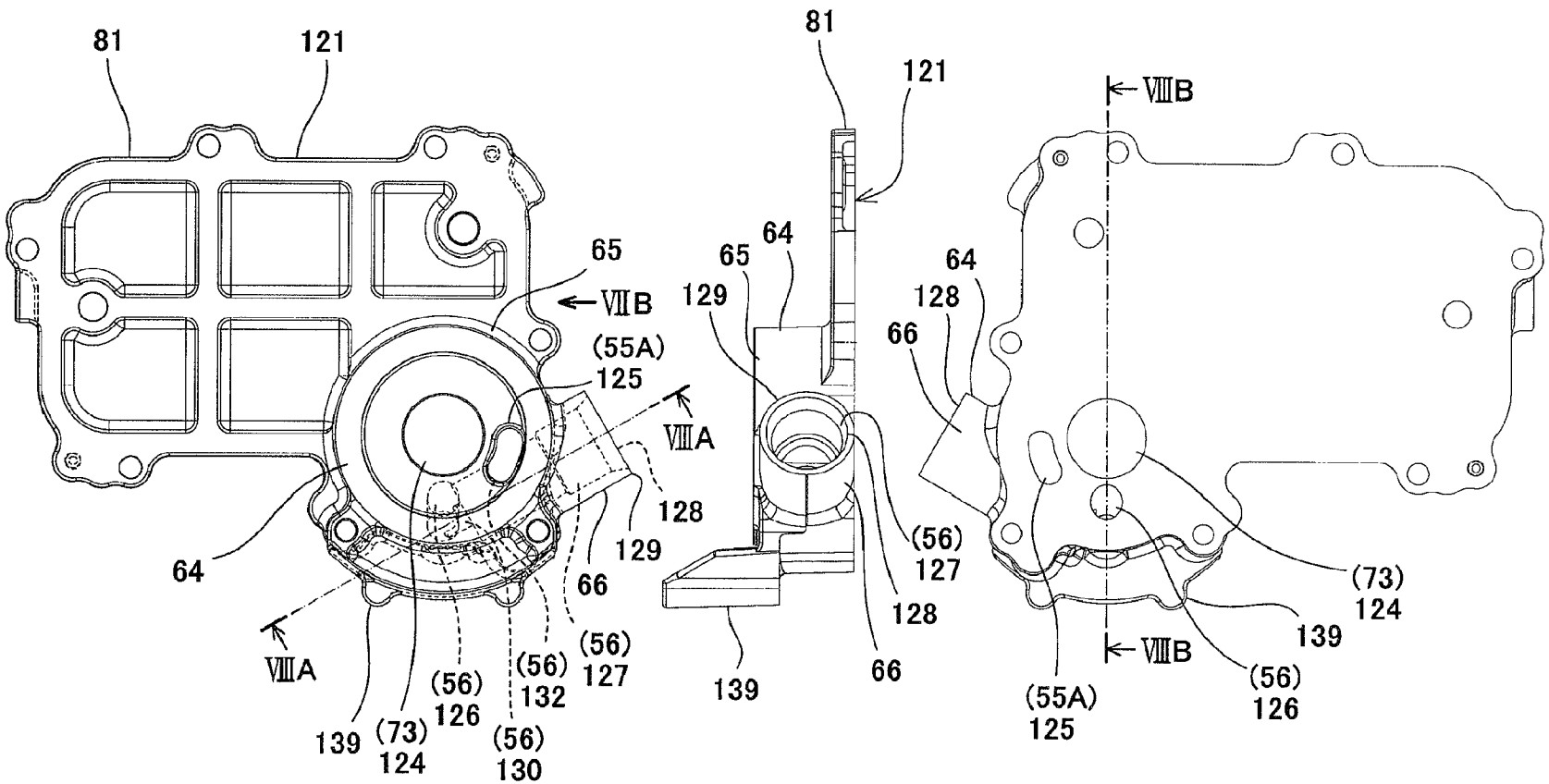
FIG. 7A is a front view of a front surface cover forming the oil cooler of FIGS. 4A and 4B.
FIG. 7B is a side view of the front surface cover taken in the direction of arrow VIIB of FIG. 7A.
FIG. 7C is a rear view of the front surface cover.

FIGS. 7A to 7C show the front surface cover 81. As shown in FIGS. 7A to 7C, the front surface cover 81 has a flat base portion 121. The back surface of the base portion 121 is flat.

The valve mounting unit 64 is provided at the front surface side of the base portion 121. The protruding member 65 of the valve mounting unit 64 has a hole 124 with a large diameter penetrating the center portion in a thickness direction (i.e., axial direction of the protruding member 65 and normal line direction of the front surface of the base portion 121). The hole 124 forms the through-hole 73 with which the pipe member 72 (see FIG. 4B) is mounted. An oil outflowing hole 125 is formed in the vicinity of the hole 124 so as to penetrate the base portion 121 and the protruding member 65 in the thickness direction thereof. The oil outflowing hole 125 is disposed so as to overlap the terminal end portion of the oil channel 101 of the passage plate 83 as viewed from the front (see two-dotted line of FIG. 6C).

Turning back to FIG. 4B, the coolant passage 52 and the oil cooling passage 53 will be described. The three members 81 to 83 are stacked to form the coolant passage 52 and the oil cooling passage 53 inside the oil cooler 51. That is, the coolant channel 113 of the passage plate 83 is closed by the front surface of the back surface cover 83 to form the coolant passage 52. The oil channel 101 of the passage plate 83 is closed by the back surface of the front surface cover 81 to form the oil cooling passage 53. The oil cooling passage 53 is located adjacent the coolant passage 52 in the thickness direction of the cooling unit 61 of the oil cooler 51, enabling efficient heat exchange between the oil flowing through the oil cooling passage 52 and the coolant flowing through the coolant passage 52. The coolant passage 52 has a structure in which the upstream end portion is connected to the downstream end portion by two passages extending in parallel (see FIG. 6C). Such a structure can lessen a temperature increase in the coolant at the downstream end portion, improving oil cooling efficiently, as compared to a structure in which the upstream end portion is directly connected to the downstream end portion by a single passage.

The upstream end portion (start end portion of the oil channel 101) of the oil cooling passage 53 communicates with the engine oil passage 79 via the oil inflowing hole 103 of the passage plate 83 and the oil inflowing hole 93 of the back surface cover 82. The downstream end portion of the oil cooling passage 53 (i.e., the terminal end portion of the oil channel 101) communicates with the inside of the oil filter 45 mounted to the protruding member 65 via the oil outflowing hole 125 of the front surface cover 81. Therefore, the oil inflowing holes 93 and 103 form a part of the first oil passage 54 and the oil outflowing hole 125 forms a part of the upstream end portion 55A of the second oil passage 55.

Figure 8B:
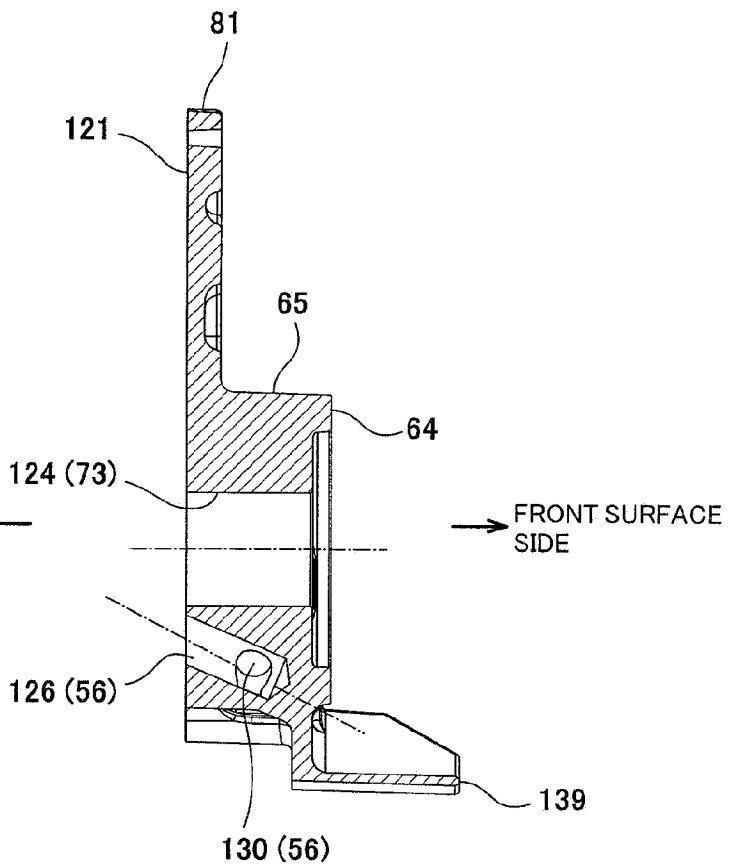
FIG. 8B is a cross-sectional view of the front surface cover taken along line VIIIB-VIIIB of FIG. 7C.
Figure 8A:
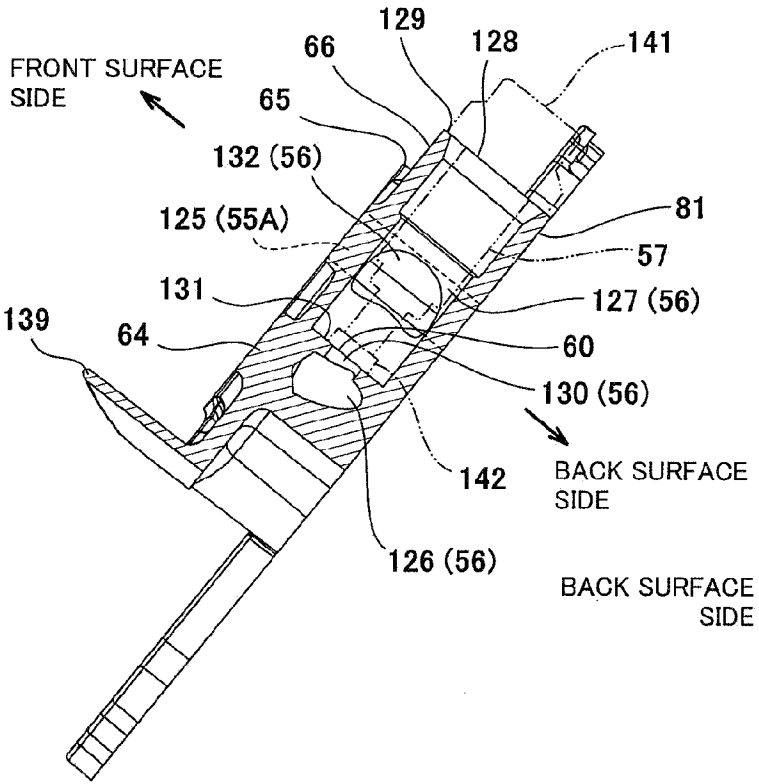
FIG. 8A is a cross-sectional view of the front surface cover taken along line VIIIA-VIIIA of FIG. 7A.

FIG. 8A is a cross-sectional view of the front surface cover 81, taken along line VIIIA-VIIIA of FIG. 7A, and FIG. 8B is a cross-sectional view of the front surface cover 81 taken along line VIIIB-VIIIB of FIG. 7C. Hereinafter, the structure of the valve mounting unit 64 and the structure of the bypass passage 56 will be described with reference to FIGS. 7A to 8B. In FIGS. 8A and 8B, the valve 57 is indicated by an imaginary line for convenient explanation of the cross-sectional shape of the valve mounting unit 64.

As shown in FIG. 7B, the protruding member 65 of the valve mounting unit 64 is disposed at the lower corner portion of the base portion 121 as viewed from the normal line direction of the front surface of the base portion 121. A part of the outer side surface of the base portion 121 is smoothly continuous with a part of the protruding member 65. The valve accommodating member 66 of the valve mounting unit 64 is cylindrical and protrudes outward from the continuous portion. In other words, the valve accommodating member 66 protrudes outward relative to the outer periphery of the base portion 121 when the base portion 121 is viewed from the front surface. The outer diameter of the valve accommodating member 66 is substantially equal to a sum of the thickness of the base portion 121 and the thickness of the protruding member 65 which are partially continuous with each other. The valve accommodating member 66 is disposed so as to overlap the base portion 121 as viewed from the side. This makes it possible to effectively use the thickness of the base portion 121 when the valve accommodating member 66 of a certain size is provided so as to protrude outward from the front surface cover 81. As a result, the axial length of the protruding member 65 can be reduced.

As indicated by a broken line of FIG. 7A, an oil inflowing hole 126 is formed in the front surface side cover 81 in the vicinity of the hole 124 so as to open in the back surface of the base portion 121. The oil inflowing hole 126 extends through the inside of the protruding member 65 to an intermediate position and does not open in the front surface of the protruding member 65.

As shown in FIGS. 7A and 8A, the valve accommodating member 66 is cylindrical and opens at the tip end. The cylindrical inner space of the valve accommodating member 66 forms a valve space 127 for accommodating the valve 57. The opening at the tip end of the valve accommodating member 66 forms a valve insertion opening 128 through which the valve 57 is inserted into the valve space 127. The tip end portion of the valve accommodating member 66 has a ring-shaped end surface defining the valve insertion opening 128. The end surface forms a plug seat 129 on which a plug 141 of the valve 57 is seated. The plug 141 serves to close the valve insertion opening 128.

As shown in FIG. 7A, the axial direction of the valve space 127 extends obliquely upward in a direction closer to the valve insertion opening 128. For this reason, in a state where the oil cooler 51 is mounted to the engine 8, the valve accommodating member 66 extends obliquely upward. The valve insertion opening 128 formed at the tip end of the valve accommodating member 66 extending obliquely upward is disposed outside the cooling unit 61 (see FIG. 3) as viewed from the normal line direction of the front surface of the cooling unit 61. Therefore, the plug 141 (see FIGS. 3 and 8A) for closing the valve insertion opening 128 is oriented obliquely upward and is disposed outside the cooling unit 61. For this reason, the rider can easily access the plug 141 of the valve 57 in the state where the engine room is open. In addition, the valve 57 is easily mountable and removable using the plug 141 protruding outside. Thus, the rider can easily carry out maintenance of the valve 57. The reason why the valve accommodating member 66 is oriented obliquely upward is that the valve accommodating member 66 is caused to overlap the base portion 121 to efficiently make use of the thickness of the base portion 121 when the valve accommodating member 66 is disposed in the state where the valve mounting unit 64 is disposed at the lower corner portion of the cooling unit 61. In a state where the valve mounting unit 64 is disposed at the upper portion of the cooling unit 61 or the valve accommodating member 66 is disposed only at the outer surface of the protruding member 65 so as not to overlap the base portion 121 in the thickness direction, the axis of the valve accommodating member 66 may be oriented upward and the plug 141 may be oriented upward.

As shown in FIG. 8A, the valve space 127 extends inside the valve accommodating member 66 and the protruding member 65, and the bottom surface of the valve space 127 is in close proximity to the tip end portion of the oil inflowing hole 126. The valve inflowing hole 130 is connected to the tip end portion of the oil inflowing hole 126. The valve inflowing hole 130 opens in the bottom surface of the valve space 127. The valve inflowing hole 130 has a circular cross-section and is disposed coaxially with the axis of the valve accommodating member 66. Since the valve space 127 has a larger inner diameter than the valve inflowing hole 130, the bottom surface of the valve space 127 has a ring-shape surrounding the valve inflowing hole 130. The ring-shaped bottom surface forms a valve seat 131 on which the valve body 142 of the valve 57 is seated. A valve outflowing hole 132 opens in the peripheral surface defining the valve space 127. The valve space 127 communicates with the oil outflowing hole 125 via the valve outflowing hole 132.

As shown in FIG. 8B, the oil inflowing hole 126 extends to be tilted with respect to the axial direction of the hole 124 and the protruding member 65. Since the oil inflowing hole 126 is tilted in this way, the axis of the oil inflowing hole 126 is more distant from the axes of the hole 124 and the protruding member 65 in a direction toward the tip end (front surface side).

As shown in FIG. 7A, since the oil inflowing hole 126 is formed as described above, the axis of the valve space 127 connected to the tip end portion of the oil inflowing hole 126 and the axis of the hole 124 extend as skew axes. This makes it possible to avoid the interference between the oil outflowing hole 125 extending in close proximity to and in parallel with the hole 124 and the valve space 127, even when the inner diameter of the valve space 127 is made larger. Therefore, the size of the valve 57 need not be reduced with precision and thus the valve 57 can be manufactured easily.

Figure 9:
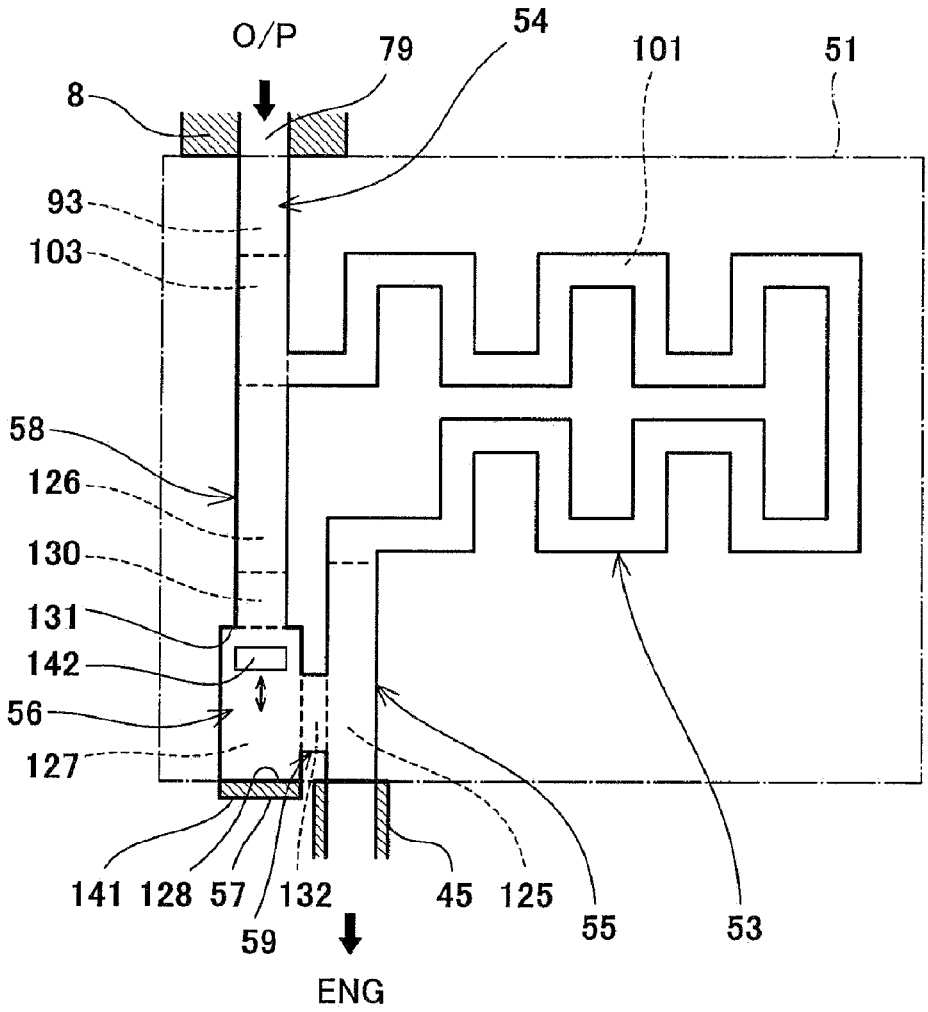
FIG. 9 is a schematic view showing a passage structure of a lubricating system in the interior of the oil cooler of FIG. 4B.

FIG. 9 is a schematic view showing a passage structure of the lubricating system inside the oil cooler 51. As described above, the engine passage 79, and the oil inflowing holes 93 and 103 form a part of the first oil passage 54, and the oil outflowing hole 125 forms a part of the upstream portion 55A of the second oil passage 55. The oil inflowing hole 103 forming a part of the first oil passage 54 communicates with the oil outflowing hole 125 forming a part of the upstream portion 55A of the second oil passage 55 via the oil inflowing hole 126, the valve inflowing hole 130, the valve space 127 and the valve outflowing hole 132 of the front surface cover 81 (see FIG. 7A). In other words, the bypass passage 56 is formed by providing communication between the holes 113, 126, 130, and 132 and the space 127 and is formed inside the oil cooler 51. The oil inflowing hole 103, the oil inflowing hole 126 and the valve inflowing hole 130 form a valve inlet passage 58 for causing the first oil passage 54 to communicate with the valve space 127. The valve outflowing hole 132 forms a valve outlet passage 59 for causing the valve space 127 to communicate with the second oil passage 55.

Since the oil inflowing hole 126 is tilted as described above, the inner diameter of the valve space 127 can be made larger. Since the valve space 127 forms the bypass passage 56, the passage cross-sectional area of the bypass passage 56 can be made larger. The oil cooling passage 53 is formed by closing the oil channel 101 formed on the front surface of the passage plate 83. The oil cooling passage 53 has a passage cross section which is substantially as small as the thickness of the passage plate 83. Since the oil channel 101 has a labyrinth shape extending sinuously, the oil cooling passage 53 has a larger passage length than the bypass passage 56. Therefore, as described above, the oil cooling passage 53 has a larger passage resistance than the bypass passage 56. As a result, the flow rate control can be executed properly using the single valve 57.

Figure 10B:
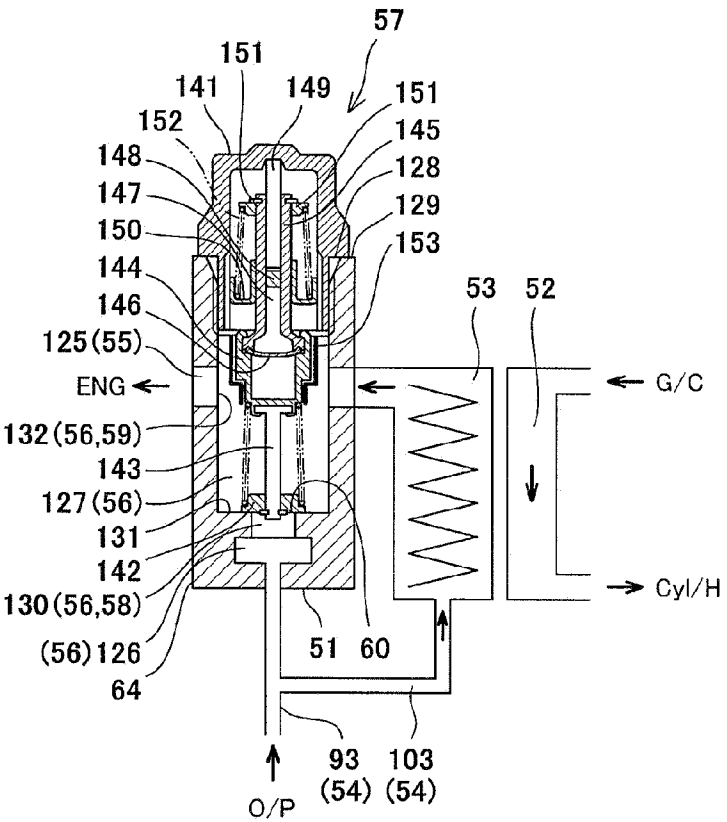
FIG. 10B is a view showing a state where the valve closes the bypass passage.
Figure 10A:
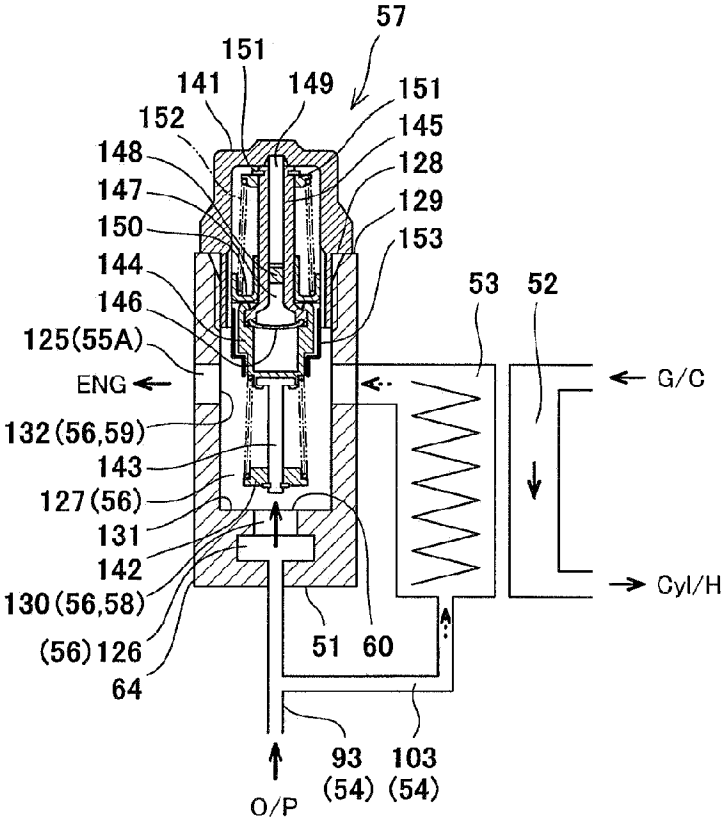
FIG. 10A is a view showing a state where the valve of FIG. 3 opens a bypass passage.

Subsequently, the structure of the valve 57 will be described with reference to FIGS. 10A and 10B. FIG. 10A is a view showing the state where the valve 57 opens the bypass passage 56 and FIG. 10B is a view showing the state where the valve 57 closes the bypass passage 56. FIGS. 10A and 10B show the valve 57 mounted to the valve mounting unit 64. For the sake of simplicity of the structure and operation of the valve 57, the cross-sectional shape of the valve mounting unit 64 as viewed from the direction perpendicular to the direction from which the valve mounting unit 64 is viewed in FIG. 8A is illustrated partially schematically.

As shown in FIG. 10A, the valve 57 includes the plug 141 for closing the valve insertion opening 128. The valve body 142 is movable along the axial direction of the valve space 127 in the interior of the valve space 127 closed by the plug 141. As used herein, in the direction in which the valve body 142 is movable in the axial direction of the valve space 127, the direction closer to the valve seat 131 is expressed as one direction and the direction closer to the plug 141 is expressed as the opposite direction, and the end portion closer to the valve seat 131 is expressed as one end portion and the end portion closer to the plug 141 is expressed as the opposite end portion.

A stem 143 is fastened to the valve body 142. The stem 143 extends in the opposite direction. The opposite end portion of the stem 143 is held at the one end portion of the stem holder 144 of a steeped cylinder shape. A cylindrical sleeve 145 with open axial end portions is fastened to the opposite end portion of the stem holder 144. The sleeve 145 extends from the stem holder 144 in the opposite direction. A circular seal sheet 146 is provided at a coupling portion where the sleeve 145 and the stem holder 144 are coupled to each other. The seal sheet 146 separates the cylindrical inner space of the sleeve 145 in a sealed state with respect to the cylindrical inner space of the stem holder 144. A deformable element 147 which is thermally deformable and a seal block 148 are accommodated in the cylindrical inner space of the sleeve 145. The deformable element 147 is filled into a space formed between the seal sheet 146 and the seal block 148. The deformable element 147 is formed of, wax, for example, and is thermally expandable and contractible. A rod 149 is inserted into the cylindrical inner space of the sleeve 145. The one end portion of the rod 149 is in contact with the seal block 148 and the opposite end portion thereof is in contact with the inner surface of the plug 141. The sleeve 145 is guided by the rod 149 such that the sleeve 145 is axially slidable.

A retainer 150 is externally fitted to the one end portion of the sleeve 145. The retainer 150 is fastened to the inner peripheral surface of the valve space 127. In addition, another retainer 151 is fastened to the opposite end portion of the sleeve 145. A coil spring 152 is mounted between the two retainers 150 and 151 so as to surround the sleeve 145. The sleeve 145 is biased in the opposite direction by a resilient force from the coil spring 152.

A cylindrical heat sensitive element 153 is externally fitted to the stem holder 144. The surface of the heat sensitive element 153 is exposed inside the valve space 127. The heat sensitive element 153 is made of a material with a high heat conductivity. The heat sensitive element 153 is sensitive to the heat of the oil flowing through the valve space 127 and the heat sensitive element 153 changes with the temperature sensitively. The stem holder 144 and the sleeve 145 are also formed of a material with a relatively high heat conductivity. The heat of the heat sensitive element 153 is transferred to the deformable element 147 via the stem holder 144 and the sleeve 145.

In accordance with the valve 57 described above, the plug 141, the rod 149, the seal block 148, and the retainer 150 are fixed to the oil cooler 51, while the valve body 142, the stem 143, the stem holder 144, the sleeve 145, the seal sheet 146, the retainer 151 and the heat sensitive element 153 are movable with respect to the oil cooler 51. The movable members are movable along the axial direction of the valve space 127 according to the deformation of the deformable element 147 and is biased in the opposite direction of the axial direction by the coil spring 152.

As shown in FIG. 10A, when the temperature of the oil flowing through the first oil passage 54 is lower than a predetermined value, the heat sensitive element 153 is subjected to lower-calorie heat of the oil, and the lower-calorie heat is transferred to the deformable element 147. Therefore, the deformable element 147 is contracted. When the deformable element 147 is contracted, the volume of the deformable element 147 occupying the cylindrical inner space of the sleeve 145 decreases and a distance between the seal seat 146 and the seal block 148 is short. Thereby, the sleeve 145 is biased in the opposite direction by the resilient force of the coil spring 152, maintaining a state where the deformable element 147 is filled into the space between the seal seat 146 and the seal block 148. Since the sleeve 145 is biased in this way, the valve body 142 moves away from the valve seat 131. Thereby, the communicating port 60 for causing the valve inlet passage 58 to communicate with the valve space 127 is opened and the bypass passage 56 is opened. Under this condition, the oil flowing through the first oil passage 54 can flow through the bypass passage 56.

As shown in FIG. 10B, when the temperature of the oil flowing through the first oil passage 54 is not lower than the predetermined value, the heat sensitive element 153 is subjected to higher-calorie heat of the oil, and the higher-calorie heat is transferred to the deformable element 147. Therefore, the deformable element 147 is expanded. When the deformable element 147 is expanded, the volume of the deformable element 147 occupying the cylindrical inner space of the sleeve 145 increases. Since the seal block 148 is supported by the plug 141 via the rod 149, the seal seat 146 moves away in the axial direction from the seal block 148, according to the expansion of the deformable element 147. According to this movement, the sleeve 145 moves in the one direction against the resilient force of the coil spring 152, causing the valve body 142 to be seated on the valve seat 131. Thereby, the communicating port 60 for causing the valve inlet passage 58 to communicate with the valve space 127 is closed and the bypass passage 56 is closed. Under this condition, the oil flowing through the first oil passage 54 can flow only through the oil cooling passage 53.

In the state shown in FIG. 10B, the oil does not flow through the valve space 127. In this case, the oil which has flowed in the oil cooling passage 53 is guided to the oil filter 45 through the oil outflowing hole 125. The valve space 127 communicates with the oil outflowing hole 125 via the valve outflowing hole 132, and the heat sensitive element 153 is positioned in the vicinity of the valve outflowing hole 132. To be more specific, the heat sensitive element 153 overlaps the valve outflowing hole 132 as viewed from the direction perpendicular to the axial direction regardless of the location of the valve body 142. Therefore, even in the state where the bypass passage 56 is closed, the heat sensitive element 153 is subjected to heat of the oil flowing through the oil outflowing hole 125, and the bypass passage 56 is opened according to the decreased temperature of the oil.

The deformation amount of the deformable element 147 which is deformed when the valve body 142 is seated on the valve seat 131 is pre-controlled in association with the temperature of the oil. To be specific, the deformable element 147 is configured to be deformed so that the valve body 142 is firmly seated on the valve seat 131 when the temperature of the oil is a predetermined value. In this way, the valve 57 is opened and closed according to the temperature without any electronic instrument. This simplifies the configuration of the lubricating system.

The valve 57 operates according to the temperature of the oil. The temperature of the oil is controlled regardless of the temperature of the coolant. If the valve 57 is configured to be opened and closed according to the temperature of the coolant in an open-loop water cooling system, the instrument for sensing the temperature of the coolant needs to have anticorrosion to prevent salt damage, because sea water is sometimes used as the coolant. In contrast, the heat sensitive element 153 of this embodiment contacts the oil and senses the temperature of the oil. Therefore, the heat sensitive element 153 need not be salt-proof. In addition, the material of the heat sensitive element 153 can be selected giving priority to the heat conductivity, improving performance of the valve 57 according to the oil temperature.

The configuration of the watercraft 1 is not limited to the above explained configuration. For example, the oil filter 45 may be positioned upstream of the oil cooler 51. The bypass passage 56 may be provided outside the oil cooler 51. The valve 57 and the oil filter 45 may be physically distant from the oil cooler 51.

Figure 11:
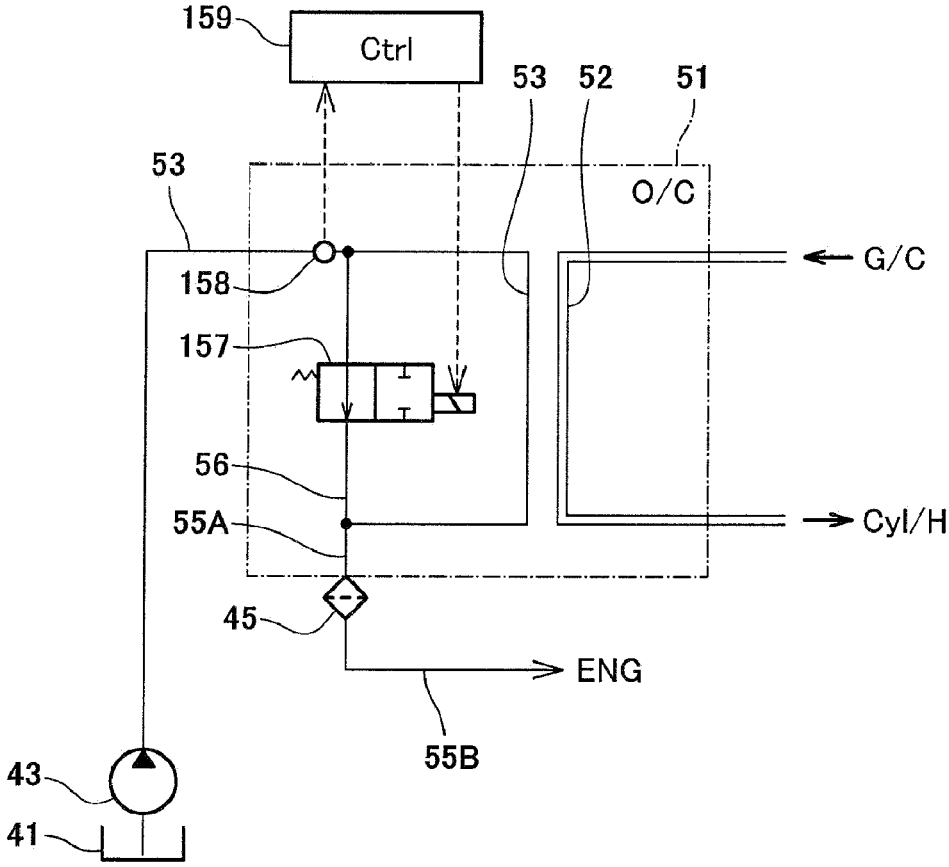
FIG. 11 is a schematic view showing a configuration of a lubricating system including a valve according to a modification.

The configuration for utilizing the thermal deformation need not be used so long as the valve is operable according to the temperature of the oil. FIG. 11 is a schematic view showing a configuration of a lubricating system including a valve 157 of a modification. As shown in FIG. 11, the valve 157 may be an electromagnetic on-off valve, for example. In this case, the watercraft 1 further includes a temperature sensor 158 configured to detect the temperature of the oil, and a valve controller 159 configured to drive the valve 157 based on a detection value of the temperature sensor 158. The valve controller 159 is configured to open the bypass passage 56 when the detection value of the temperature sensor 158 is lower than a predetermined value, and to close the bypass passage 56 when the detection value of the temperature sensor 158 is not lower than the predetermined value. In this case, also, the temperature of the oil is controlled to be stabilized near the predetermined value regardless of the temperature of the coolant.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A personal watercraft comprising:

an oil cooler including an oil cooling passage through which oil circulating inside an engine flows and a coolant passage through which coolant for cooling the oil in the oil cooling passage flows;

a first oil passage through which the oil flowing toward the oil cooling passage flows;

a second oil passage through which the oil flowing out from the oil cooling passage flows;

a bypass passage connecting the first oil passage to the second oil passage so as to bypass the oil cooling passage; and a valve configured to open and close the bypass passage;

wherein the oil cooler includes a valve mounting unit to which the valve is mounted; and wherein the valve opens the bypass passage when a temperature of the oil is lower than a predetermined value and closes the bypass passage when the temperature of the oil is not lower than the predetermined value.

2. The personal watercraft according to claim 1, wherein the oil cooling passage has a larger passage resistance than the bypass passage.

3. The personal watercraft according to claim 2, wherein the oil cooling passage is configured to be always open.

4. The personal watercraft according to claim 1, wherein the valve includes a valve body for opening and closing the bypass passage;

wherein the valve mounting unit includes a valve space in which the valve body is accommodated, a valve inlet passage for causing the first oil passage to communicate with the valve space and a valve outlet passage for causing the second oil passage to communicate with the valve space; and wherein the valve space, the valve inlet passage and the valve outlet passage form the bypass passage, and a valve seat is provided on a surface defining the valve space at an outer periphery of a communicating port for causing the valve inlet passage to communicate with the valve space, the valve body being seated on the valve seat.

5. The personal watercraft according to claim 4, wherein the valve mounting unit has a valve insertion opening through which the valve body is inserted into the valve space, and the valve includes a plug for closing the valve insertion opening of the valve mounting unit; and wherein the valve mounting unit further includes a plug seat provided at an outer periphery of the valve insertion opening, the plug being seated on the plug seat.

6. The personal watercraft according to claim 5, wherein the oil cooler includes a cooling unit provided with the oil cooling passage and the coolant passage, and the valve mounting unit is provided on an outer surface of the cooling unit; and wherein the plug seated on the plug seat is oriented upward or obliquely upward, and is positioned outside the cooling unit as viewed from a normal line direction of the outer surface.

7. The personal watercraft according to claim 1, further comprising:

an oil filter configured to filter the oil;

wherein the valve mounting unit includes a filter mounting member for mounting the oil filter.

8. The personal watercraft according to claim 7, wherein the oil cooler includes a cooling unit provided with the oil cooling passage and the coolant passage, and the filter mounting member is provided on an outer surface of the cooling unit; and wherein the filter mounting member and the oil filter are disposed inside the cooling unit as viewed from a normal line direction of the outer surface.

9. The personal watercraft according to claim 1, wherein the valve is an electromagnetic on-off valve, the watercraft further comprising:

a valve controller configured to control the valve; and a temperature sensor configured to detect a temperature of the oil;

wherein the valve controller causes the valve to open the bypass passage when a detection value of the temperature sensor is lower than a predetermined value and to close the bypass passage when the detection value of the temperature sensor is not lower than the predetermined value.

* * * * *